United States Patent [19]

Nelson et al.

[11] Patent Number: 4,610,312

[45] Date of Patent: Sep. 9, 1986

[54] REDUNDANT FIRING MECHANISM FOR A WELL PERFORATING GUN

[75] Inventors: John A. Nelson, Spring; Gregg W. Stout, Montgomery, both of Tex.

[73] Assignee: Baker Oil Tools, Inc., Orange, Calif.

[21] Appl. No.: 743,044

[22] Filed: Jun. 10, 1985

[51] Int. Cl.[4] ..... E21B 43/11

[52] U.S. Cl. ..... 175/4.52; 175/4.54; 175/4.56

[58] Field of Search ..... 175/4.52, 4.54, 4.56; 166/55.1, 297; 89/1.15; 102/3.8, 3.9, 320

[56] References Cited

U.S. PATENT DOCUMENTS

| | | | |
|---|---|---|---|
| 4,498,541 | 2/1985 | Brieger et al. | 175/4.52 |
| 4,509,604 | 4/1985 | Upchurch | 175/4.52 |
| 4,531,590 | 7/1985 | Peterson | 175/4.52 |
| 4,544,034 | 10/1985 | George | 175/4.54 |
| 4,564,076 | 1/1986 | Vann et al. | 175/4.54 |

*Primary Examiner*—Stephen J. Novosad
*Assistant Examiner*—William P. Neuder
*Attorney, Agent, or Firm*—Norvell & Associates

[57] ABSTRACT

A redundant firing mechanism for a perforating gun utilized in subterranean wells comprises a hollow housing assembly incorporating two spaced primer charges disposed in vertically spaced relationship. A fluid pressure chamber is defined within the hollow housing assembly and is closed at the top end of the assembly by a frangible barrier disc. A fluid pressure actuated hammer is provided to impact upon the lowermost one of the primers in response to fluid pressure developed in the fluid pressure chamber. In the event that the lowermost primer does not detonate, a detonating bar may then be dropped through the tubing string to break the frangible barrier and impact upon a second hammer disposed in overlying relationship to the second primer.

11 Claims, 8 Drawing Figures

REDUNDANT FIRING MECHANISM FOR A WELL PERFORATING GUN

BACKGROUND OF THE INVENTION

1. Field of the Invention

The invention relates to a firing mechanism for a gun utilized to effect the perforation of a subterranean well casing or liner having a primary actuator utilizing a fluid pressure force to detonate a first primer and a secondary or backup actuator utilizing a mechanical impact force to detonate a second primer to effect the firing of the gun in the event that the first primer fails to fire the gun.

2. Description of the Prior Art

Perforating guns have long been employed to effect the perforation of a well casing or liner in the vicinity of a production zone and to produce passages extending into such production zone. The popular perforating guns now uniformly employ the so-called "shaped charges," which are disposed in vertically and angularly spaced relationship relative to the casing axis so as to produce a large number of evenly spaced perforations with a single firing. Such shaped charges are generally ignited by a primer cord which contacts a primer end of each shaped charge container to detonate the charge contained within each such container.

The ignition of the primer cord has heretofore been generally accomplished by the production of an impact force on a detonatable primer. In some firing mechanisms, the impact force is produced by a fluid pressure actuated hammer which is driven by the fluid pressure into impact engagement with the primer. In other firing mechanisms, and particularly for perforating guns carried into the well on a tubing string, the detonation of the primer has been accomplished by the dropping of a detonating bar through the tubing string to impact upon a firing pin which in turn pierces the primer.

Regardless of the type of firing mechanism, i.e., whether fluid pressure actuated or mechanically actuated, the perforating of subterranean wells has been plagued by a failure of the primer charge to detonate and thus ignite the primer cord and effect the detonation of the shaped charges. Many well perforating operations are now performed by a perforating gun which is suspended from a packer which in turn is run into the well on a tubing string. With this arrangement, the packer may be set in the well casing at a position to locate the perforating gun adjacent to the production zone to be perforated. Once the packer is set, the casing annulus below the packer is isolated from the casing annulus above the packer. This permits the perforating operation to be performed with the fluid pressure in the casing annulus adjacent the production zone being reduced to a level below the anticipated fluid pressure of the production fluid. This operation is commonly referred to as perforating in an underbalanced condition. The primary advantage of underbalanced perforation is that it permits an immediate flow of production fluid from the passages in the perforated production zone and thus flushes out the debris which is normally associated with the perforating operation.

Since control of the fluid pressures in the vicinity of the perforating gun is essential to perform underbalanced perforating, it is only natural that a fluid pressure actuated firing mechanism for the perforating gun is a preferred mode of effecting the detonation of the shaped charges of the gun. However, even though proper pressures are applied to a hammer which is slidably and sealably mounted in a fluid pressure chamber above a detonatable primer, the application of a fluid pressure force to the hammer to drive it into impact engagement with the primer does not always result in the detonation of the primer and the firing of the perforating gun. This necessarily means that the entire tubing string, packer, firing mechanism and perforating gun must be removed from the well with the attendant substantial increase in completion time and cost.

There is, therefore, a definite need and economic justification for a backup or redundant firing system which can be mechanically actuated in the event of failure of the fluid pressure actuated firing mechanism to effect the firing of the perforating gun.

SUMMARY OF THE INVENTION

This invention provides a redundant firing mechanism for a perforating gun for a subterranean well wherein the normal firing of the gun is accomplished through the application of fluid pressure forces to a hammer to drive the hammer into impact engagement with a first detonatable primer. In the event of failure of the primer to detonate, a secondary firing system is provided, including a second detonatable primer, which is detonated by the dropping of a detonating bar through the tubing string to produce a mechanical impact force on the second primer and thus achieve the firing of the perforating gun.

The apparatus embodying this invention comprises an elongated hollow housing which is normally secured between the top end of a perforating gun housing or carrier and the bottom end of a packer. The packer is set in normal fashion to position the perforating gun adjacent the production zone to be perforated. Within the hollow housing containing the redundant firing mechanism, a first detonatable primer is fixedly positioned adjacent the lower end of the housing. Above the first primer a fluid pressure chamber is provided. Within the lower portions of the fluid pressure chamber, a piston-like hammer is slidably and sealably mounted for movements toward the first primer. The hammer is normally releasably secured in an elevated position relative to the first primer by a latching mechanism which will not release the hammer until a sufficient pressure differential exists across the top and bottom portions of the hammer to insure that it will be driven downwardly with sufficient force to effect the detonation of the first primer.

A fluid pressure differential is then produced across the hammer by conduit means well known to those skilled in the art. For example, the fluid pressure in the casing annulus above the set packer may be transmitted to the upper portions of the fluid pressure chamber through the provision of an axial fluid passage in the body of the packer. At the same time, the fluid pressure existing in the tubing string is transmitted outwardly into the casing annulus below the packer through the provision of a radially ported crossover having its radial ports located below the set packer. Upon creating a pressure differential between the casing annulus fluid pressure and the tubing pressure, a similar pressure differential will be imposed across the hammer. When this differential reaches a predetermined level, the latching mechanism is released and the hammer is driven downwardly into impact engagement with the first primer.

A second primer is provided at an elevated position within the hollow housing relative to the first primer. The second primer has a second hammer slidably mounted immediately above it and secured by a shear pin in an inoperative position relative to the second primer. The second hammer is concentrically disposed within the hollow housing and may be driven downwardly to impact against the second primer by the dropping of a detonating bar through the tubular string.

Each of the primers is provided with means for transmitting their detonating energy to the primer cord of the perforating gun which traverses each of the shaped charges mounted in such gun. For example, the first primer may be connected by a booster charge to a short length of primer cord which extends downwardly into the top portions of the perforating gun housing where it terminates in another booster charge disposed in vertically adjacent relationship to a booster charge provided on the top end of the primer cord which traverses all of the shaped charges of the perforating gun.

The detonating energy of the second primer may be conveniently transmitted downwardly past the fluid pressure actuated firing mechanism for the first primer by a detonation conducting tubing which is joined by a booster charge to the aforementioned short length of primer cord used to transmit the detonating energy from the first primer. Of course, a separate length of primer cord could be employed for this purpose if desired.

Other advantages of the invention will be readily apparent to those skilled in the art from the following detailed description, taken in conjunction with the annexed sheets of drawings, on which is shown a preferred embodiment of the invention.

DESCRIPTION OF A PREFERRED EMBODIMENT

Figure 1A:
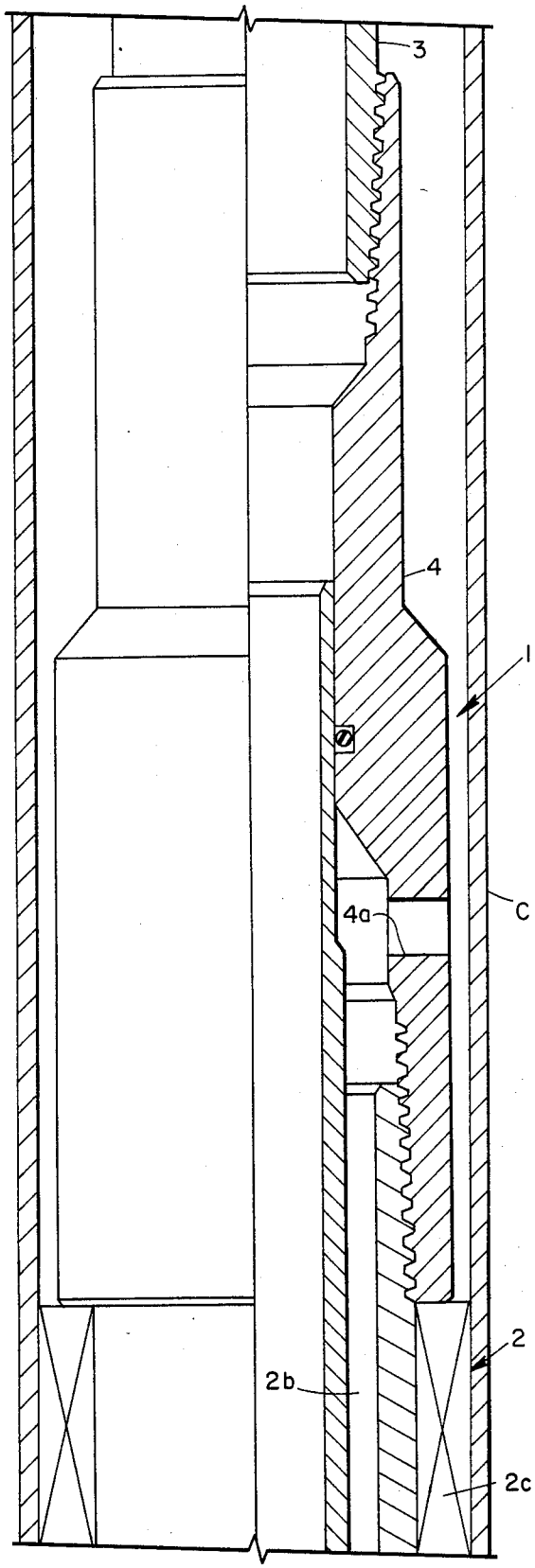
FIGS. 1A, 1B, 1C, 1D, 1E and 1F collectively represent a schematic vertical sectional view of a redundant firing mechanism embodying this invention shown in an inserted position relative to a well casing to be perforated.
Figure 1B:
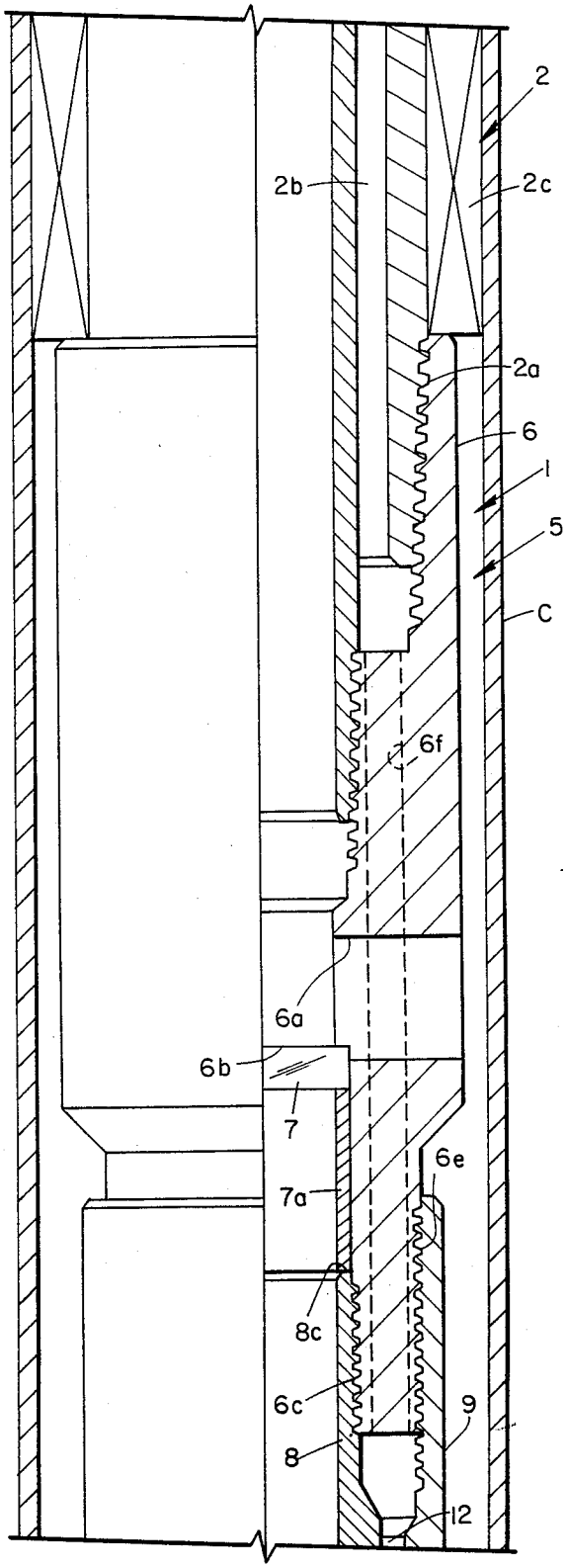

A perforating gun assembly 1 is shown in FIGS. 1A, 1B, 1C, 1D, 1E and 1F mounted in a well casing C. The assembly comprises a conventional sealing device or packer 2 which may be of either the fluid pressure or mechanically actuated type and is conventionally connected to a tubular work string 3 by an upper sub 4. Packer 2 is schematically illustrated in its set position within the well casing C.

A tubular housing assembly 5 containing both a mechanical and a hydraulic firing mechanism is connected to the lower end of the body of packer 2 by external threads 2*a*. The tubular assembly 5 comprises at its upper end a ported crossover sub 6 having a plurality of peripherally spaced flow ports 6*a* formed in the side walls thereof at a position below the sealing elements 2*c* of the packer 2. At its lower end, the ported sub 6 defines a downwardly facing internal shoulder 6*b* against which a frangible barrier disc 7 is secured by a spacer sleeve 7*a* which is supported on an upwardly facing surface 8*c* of a downwardly extending inner tube 8 which is secured to internal threads 6*c* provided on the bottom end of the ported sub 6. Barrier disc 7 prevents trash from falling into the firing mechanism and any accumulated trash may be cleaned therefrom by circulating fluid through radial ports 6*a*.

A plurality of axially extending ports 6*f* are provided in the wall of ported sub 6 and respectively communicate with axial passages 2*b* provided in the body portion of the packer 2. Axial passages 2*b* communicate with radial ports 4*a* in upper sub 4. In this manner, fluid communication is provided around the seals of the packer 2 from the casing annulus above the packer to a point below the packer seals.

An outer sleeve 9 is secured to external threads 6*e* provided on the bottom end of ported sub 6 and outer sleeve 9 is secured at its bottom end by internal threads 9*a* to the top portion of a tubular body 10 which houses the fluid pressure actuated firing mechanism. The inner sleeve 8 extends downwardly in concentric relationship with the outer sleeve 9 and is secured at its bottom end to a hollow body element 11 which forms the mounting for the mechanically actuated firing mechanism. Such securement is effected by internal threads 8*b* provided on the lower portions of the inner sleeve 8 and the threads are sealed by O-rings 8*c*. An annular fluid passage 12 is thus defined between the outer and inner sleeves 8 and 9 through which casing annulus fluid pressure above the packer 2 may be transmitted downwardly to the top of the hydraulic firing mechanism body 10. A downwardly extending passage 10*a* in body 10 transmits such fluid pressure to a central bore 10*b* provided in the lower portions of the body 10 wherein the fluid pressure actuated hammer is mounted, as will be later described.

The bottom end of the body 10 is provided with external threads 10*c* to which is secured a connecting sub 15 which defines, at its bottom end, internal threads 15*a* for connection to the external threads 20*a* provided on the top portion of conventional perforating gun housing 20. Only a portion of the perforating gun 20 is shown since it can comprise any conventional form of perforating gun wherein a plurality of spaced charge containers 21, are mounted in vertically and angularly spaced relationship by a suitable carrier, such as polygonal carrier 22 shown in FIG. 1F. Further details concerning the mounting of the spaced charge containers 21 within the perforating gun 20 may be found in U.S. Pat. No. 4,479,556, entitled "Subterranean Well Casing Perforating Gun".

From the description thus far, it will be apparent that the tubular housing assembly 5 defines a fluid pressure chamber extending from the bottom of fluid passage 12 at its top end to the central bore 10*b* provided in the housing 10 within which the fluid pressure actuated firing mechanism is mounted. This chamber contains the casing annulus pressure existing above the set packer 2. The details of such fluid pressure actuated mechanism will now be described.

A primer mounting sleeve 30 is sealably inserted within the bottom end of the housing 10 by internal threads 10*d* and O-ring seal elements 30*a* provided on the exterior of the primer mounting sleeve 30. A hollow plug 31 is in turn threadably mounted in the bottom of the primer mounting sleeve 30 by threads 31*a*, and the threaded connection is sealed by an O-ring 31*b*. Plug 31 holds a detonatable primer element 32 in snug engagement with a downwardly facing shoulder 30*b* formed in the interior of the sleeve 30. O-ring 30*c* seals this abutting connection and an O-ring 32*a* seals the bottom of the primer 32 against the upwardly facing end surface of the plug 31.

Plug 31 is provided with an internal bore 31*c* and a booster charge 33 is mounted in such bore and is conventionally connected to a short length of primer cord 34 extending downwardly through the bore of the connecting sub 15 and terminating in a second booster charge 35. Booster charge 35 is spaced immediately above a booster charge 27 conventionally provided in a coupling 25 mounted in the top end of the perforating gun and providing an operative connection with the primer cord which extends through the gun to ignite all of the shaped charges 21 mounted therein.

The primer 32 is normally detonated by the pointed end 40*a* of a fluid pressure actuated hammer 40. Hammer 40 has an enlarged top end portion 41 which slidably engages the bore 45*b* of the ring portion 45*a* of a collet 45.

The flexible arm portions 45*c* of the collet 45 extend downwardly in parallel relationship to the hammer 40 and are provided with a thickened portion 45*d* along the length thereof which defines an inwardly projecting latching surface 45*e* which cooperates with a similarly inclined, downwardly facing surface 42 provided on the hammer 40 so as to retain the hammer 40 in an elevated position relative to the primer 32. Thus, sufficient fluid pressure force must be applied to the hammer 40 to cause the inclined surfaces 42 to cam the collet arms 45*c* outwardly to release the hammer to travel downwardly and impact the primer 32. It should be noted that the bottom ends of collet arms 45*c* are secured to a ring portion 45*h*.

To prevent any premature movements of the hammer 40 towards the primer charge 32, a locking sleeve piston 46 is provided which is slidably and sealably mounted within the central bore 10*b* and the enlarged bore 10*g* of housing 10. Locking sleeve piston 46 is normally positioned adjacent an outwardly projecting rib 45*f* formed on each of the collet arms 45*c* and thus positively prevents any outward displacement of the collet arms 45*c*. Locking sleeve piston 46 is secured in this locking position by a shear screw 46*c* which traverses the wall of the housing 10 and engages an annular groove 46*d* provided in such locking sleeve 46.

A sealing sleeve 47 is mounted in the housing bore 10*g* immediately below the locking sleeve piston 46 and is sealably engaged with such bore at its upper end by an O-ring 47*a*. The lower end 47*b* of the sealing sleeve 47 is of reduced diameter and mounts an O-ring seal 47*c* which sealably engages the lower portion of hammer 40. Such lower end 47*b* of sealing sleeve 47 is threadably engaged with threads 30*e* formed on the upper end of primer mounting sleeve 30. A fluid passage 10*e* is provided in the wall of body 10 and permits tubing fluid pressure from the casing annulus located below the packer surrounding the housing assembly 5 to be applied to the lower portions of the hammer 40 through a radial port 30*d* provided in the primer mounting sleeve 30. Thus, the upper portion 41 of hammer 40 is exposed to the fluid pressure existing in the casing annulus above the packer 2, through passages 6*f* and 2*b*, while the lower portion of hammer 40 is exposed to the pressure existing in the tubing string which is transmitted to the casing annulus below the packer through the radial cross-over ports 6*a*.

Figure 2A:
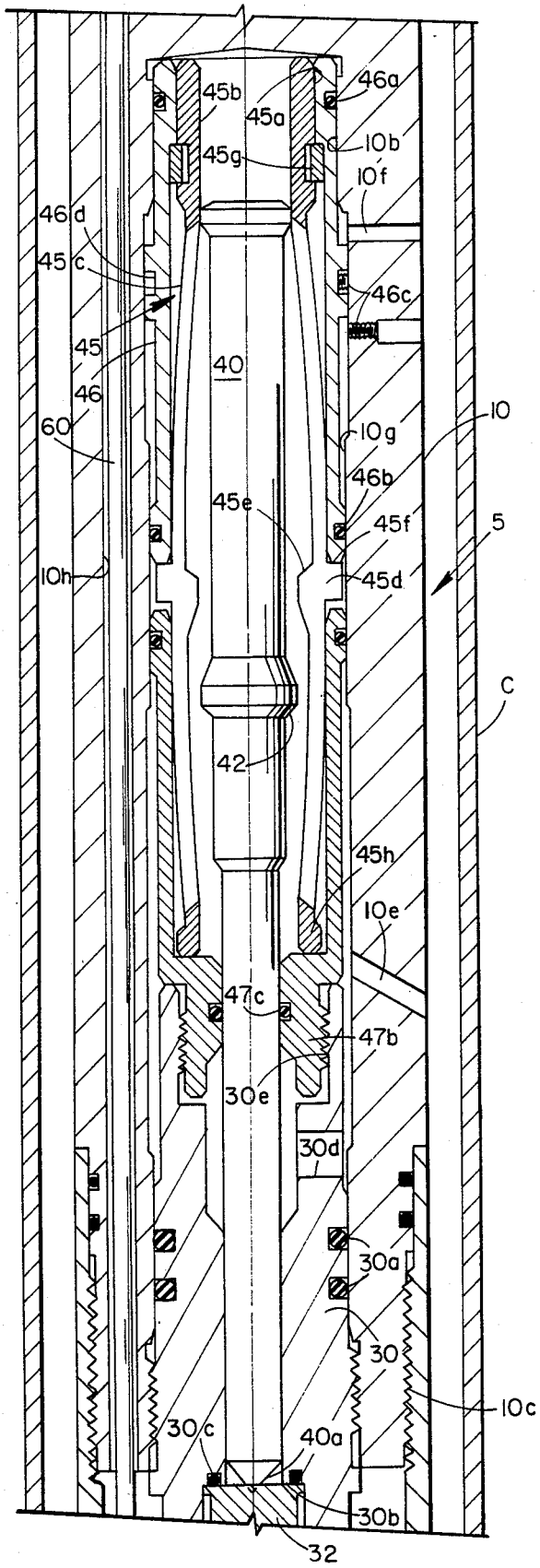
FIGS. 2A and 2B are views collectively similar to FIGS. 1D, 1E and 1F, but showing the hammer latching mechanism in an unlocked position, subsequent to releasing the hammer under fluid pressure forces.
Figure 2B:
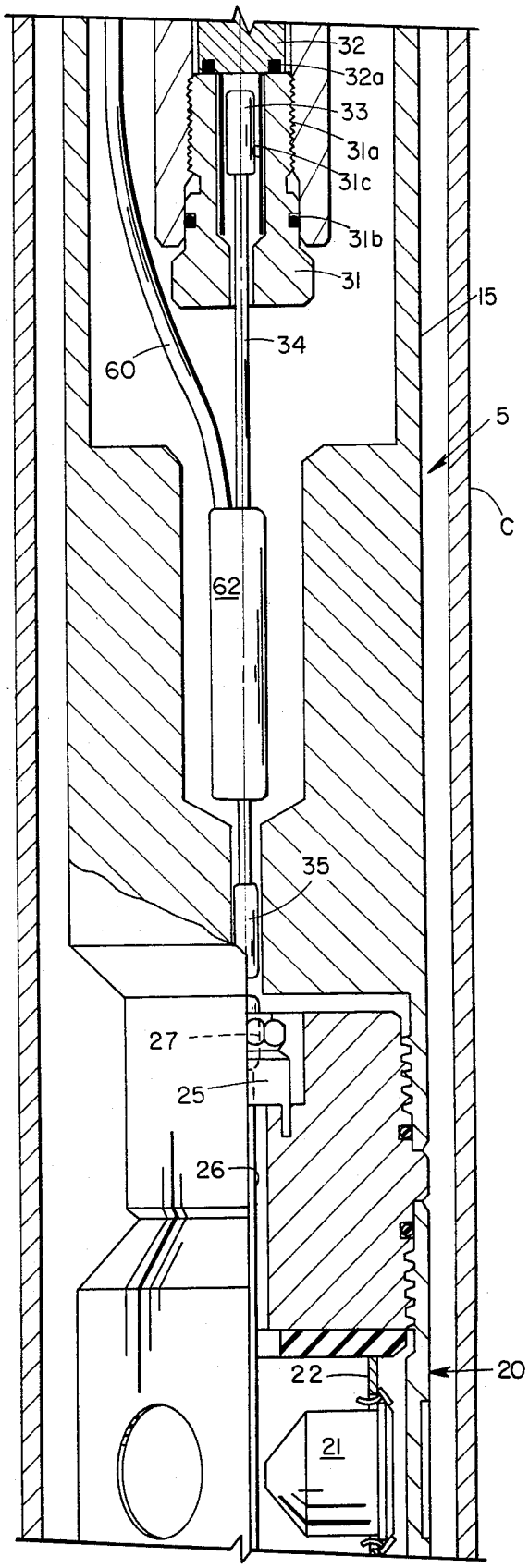

Additionally, a radial port 10*f* (FIG. 2A) is provided in the body 10 at a position intermediate O-ring seals 46*a* and 46*b* provided on the exterior of the locking sleeve piston 46. These seals contact the bore walls 10*b* and 10*g*, respectively, at different diameters and hence, when the casing annulus pressure above the packer 2 exceeds the tubing pressure, an upward force will be exerted on the locking sleeve piston 46. When such force reaches a predetermined level corresponding to the desired amount of pressure differential to be exerted on the hammer 40, the shear pin 46*c* is sheared and the locking sleeve piston 46 moves upwardly to the position illustrated in FIGS. 2A and 2B, thus permitting the hammer 40 to cam the collet arms 45*c* outwardly and drive down into impact engagement with the primer 32. Locking sleeve piston 46 is retained in such released position by a C-ring 45*g* carried on ring portion 45*a* of collet 45.

It should be noted that these pressure conditions correspond to those required to perforate the well casing in an underbalanced condition. In other words, the fluid pressure in the tubing string may be conveniently reduced to reduce the effective fluid pressure in the casing annulus below packer 2 and adjacent to the production zone to be perforated. This reduction in tubing pressure relative to the casing annulus pressure above the packer contributes to the differential pressure acting first on the locking sleeve piston 46 to release same, and then acting upon the hammer 40 to drive it into impact engagement with the primer 32.

In the event that the fluid pressure actuated firing mechanism does not successfully detonate the primer charge 32, recourse may then be had by the well operator to the mechanically actuated firing mechanism contained within the hollow body 11 which has previously been described as being located in the fluid pressure chamber defined by the hollow housing assembly 5.

The mechanical firing mechanism housing 11 (FIG. 1D) comprises an annular member having a reduced diameter bottom stem portion 11*a* which is sealably inserted within a bore 10*m* formed in the upper end of the fluid pressure firing body 10. O-ring seals 11*b* sealably secure this connection and a set screw 11*c* traversing the housing 10 locks the housing 11 into engagement with housing 10.

Body 11 has a small diameter bore 11*d* extending through its bottom portion. Such bore is provided with a first enlarged counter bore 11*e* within which is sealably mounted a second primer 36. A second enlarged counter bore 11*f* is provided immediately above the first counter bore 11*e* and this threadably mounts a hammer guide sleeve 37. An O-ring 37*a* seals the threaded connection. Guide sleeve 37 has an upper cylindrical bore 37*b* for slidably receiving therein a hammer 38. Bore 37*a* is enlarged in its lower portion to accommodate a firing pin 39 in direct overlying relationship to the second primer 36. The hammer 38 is secured in an elevated position relative to the firing pin 39 by a shear screw 38*a*.

Figure 1C:
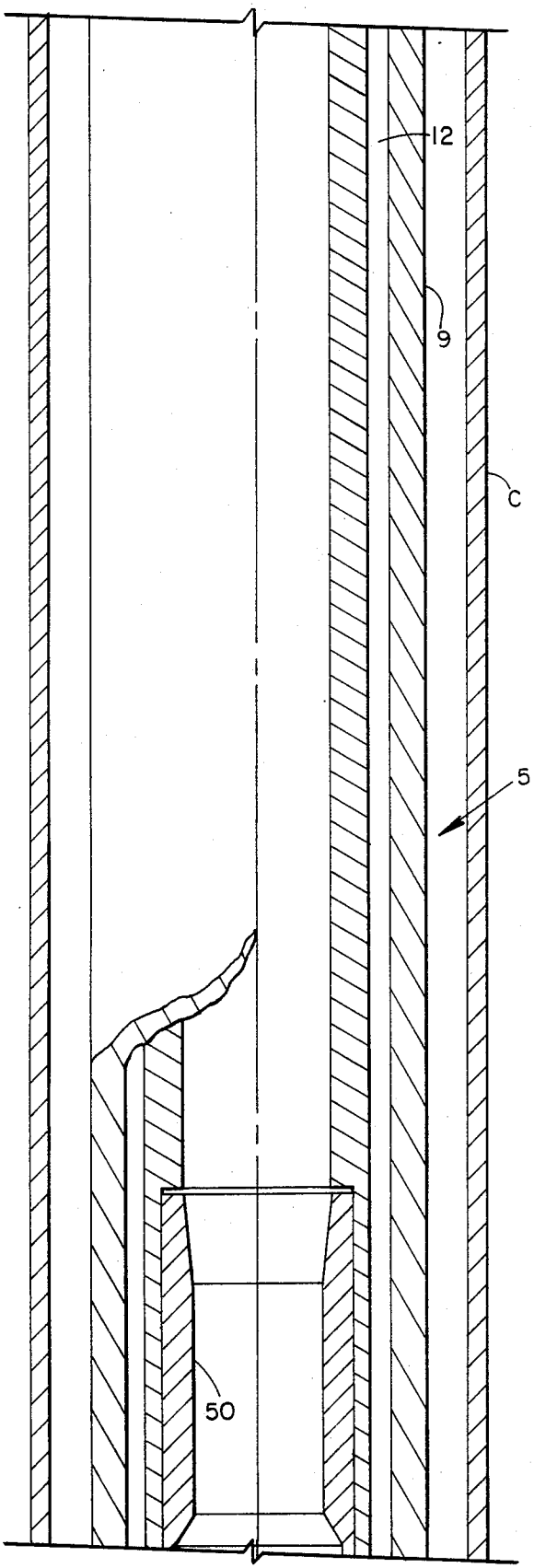
Figure 1D:
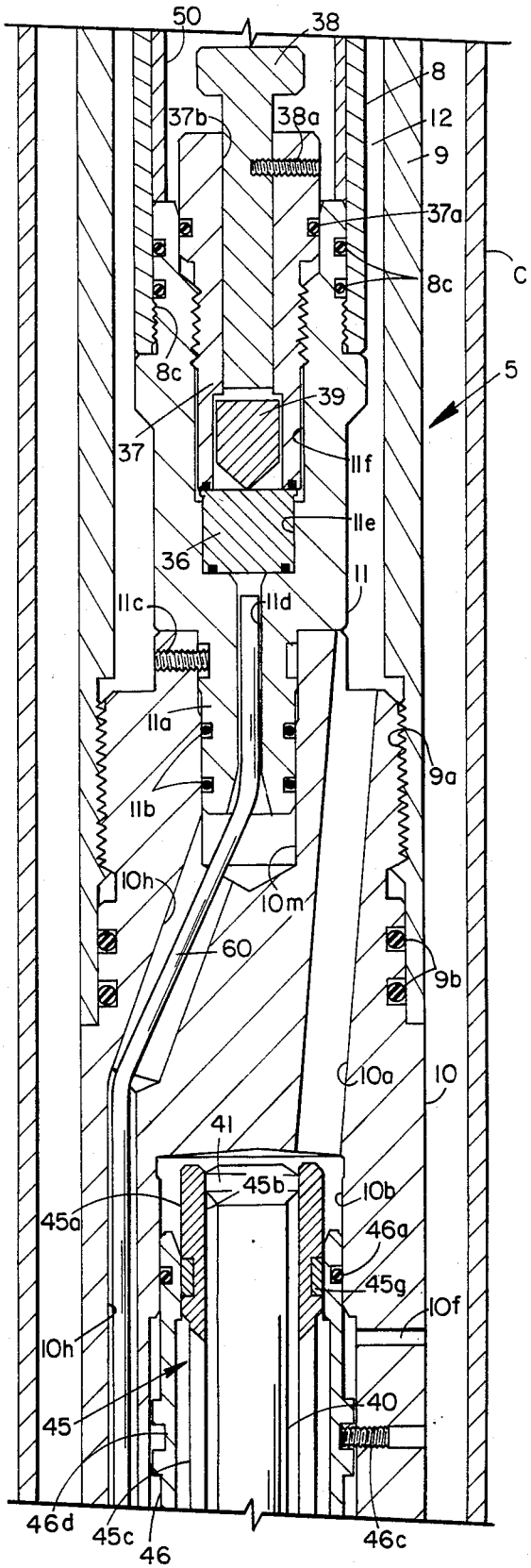
Figure 1E:
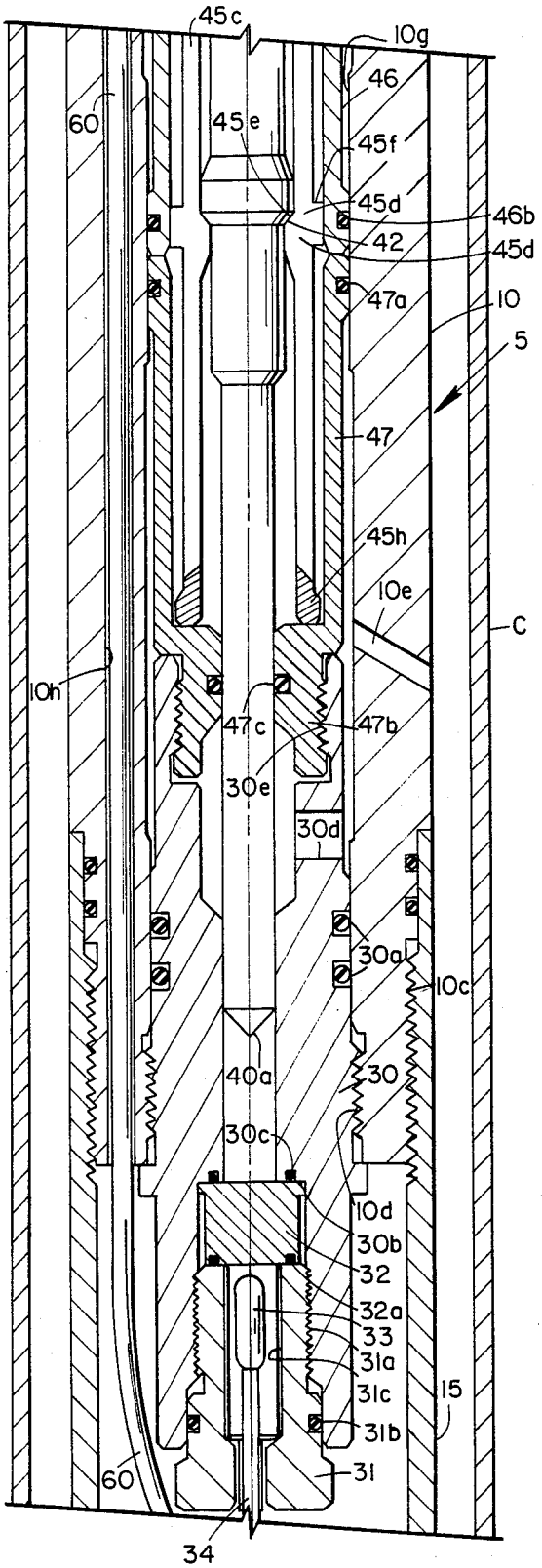
Figure 1F:
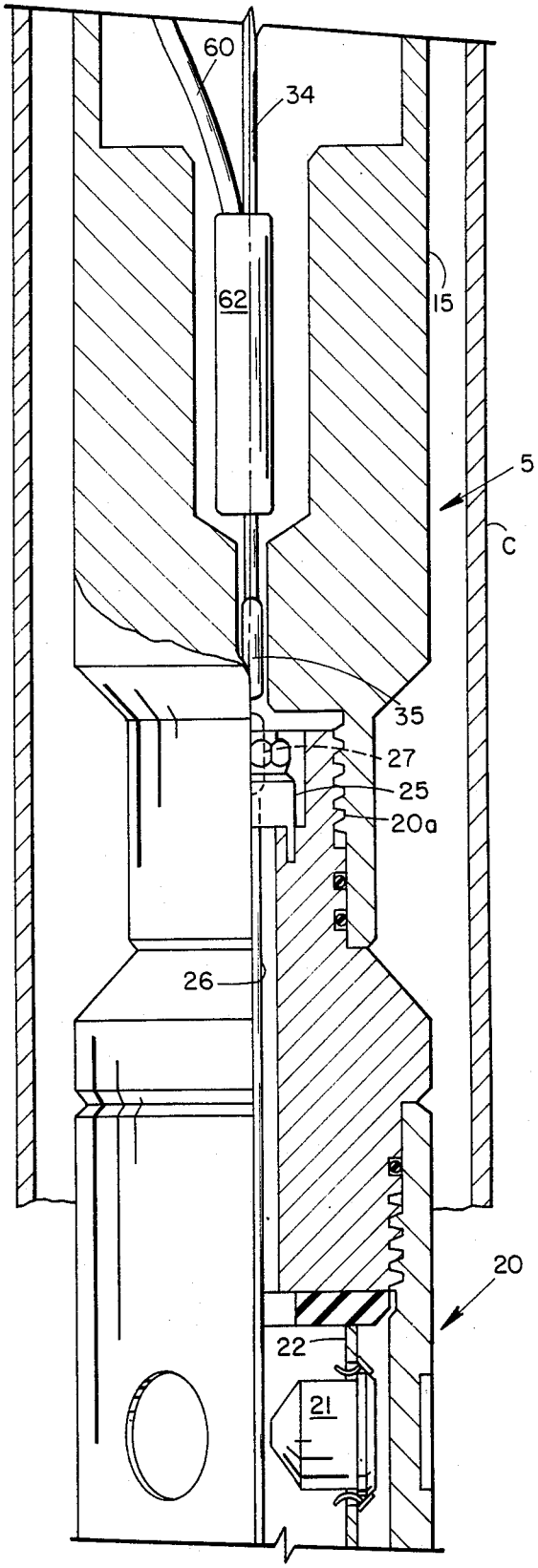

From the foregoing description, it will be apparent that a through passage is provided through the tubing string 3, the packer 2, and the inner sleeve 8 to permit the passage of detonating bar downwardly from the surface of the well to impact upon the hammer 38 and effect the firing of primer charge 36. Such detonating bar necessarily must pass through the frangible barrier 7, which it does with ease since barrier 7 is made of readily breakable glass or ceramic. If desired, a centering sleeve 50 to guide the path of the detonating bar may be mounted in the inner sleeve 8 immediately above the inoperative position of the hammer 38, as shown in FIG. 1C.

The detonating energy from the mechanically actuated second primer 36 may be transmitted to the perforating gun 20 by any conventional energy transmitting cord, such as a primer cord. Preferably, such energy is transmitted by utilization of a detonation conducting tubing 60 which comprises a plastic tube having explosive particles adhered to its inner surface so that, when ignited, ignition heat is conducted down through the bore of the tubing without exerting any explosive effects on the adjoining apparatus. Such detonation conducting tubing may comprise that sold by the Ensign-Bickford Company of Simsbury, Conn., under the trademark "NONEL". Detonation conducting tubing 60 passes downwardly through bore 11*d* through appropriate passages 10*h* provided in the body 10 and terminates in the center of connecting sub 15. The Nonel tubing 60 is connected to a conventional booster charge (not shown) having sufficient detonating energy to ignite the primer cord 34 and is secured in abutting relationship to the primer cord 34 by a sheet metal crimped connector 62. Thus, the firing of the perforating gun 20 proceeds in conventional fashion once the second primer 36 is detonated.

In the preferred embodiment of the invention heretofore described, the fluid pressure differential produced across the hammer of the hydraulically actuated firing mechanism was derived by imposing the casing annulus fluid pressure above the packer on the top portions of the hammer and subjecting the lower portions of the hammer to the fluid pressure existing in the tubing string which is transmitted by the ported sub 6 to the casing annulus below the set packer. Those skilled in the art will recognize that other arrangements for producing a pressure differential across the hammer 40 may be readily utilized. For example, the fluid pressure chamber defined within the housing assembly 5 may be supplied with pressured fluid from the casing annulus below the set packer. The vertical fluid passages 2*b* and 6*f*, respectively, provided in the packer body and in the ported sub 6 may be eliminated and the casing annulus fluid pressure supplied to the interior of the fluid pressure chamber defined within the hollow housing assembly 5 through a check valve which permits pressure to flow only into the fluid pressure chamber. Accordingly, a subsequent reduction of tubing pressure will produce a pressure differential across the hammer 40 sufficient to effect the shifting of the locking piston 46 and the driving of the hammer 40 into engagement with the first primer 32. A hydraulic charging system of this type is fully described and illustrated in co-pending application, Ser. No. 743,045, filed concurrently with this application, and entitled "Fluid Pressure Actuated Firing Mechanism For a Well Perforating Gun", and the disclosure of such application is incorporated herein by reference.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A perforating gun for perforating the casing and adjacent production formation of a subterranean well, comprising: a hollow housing containing a plurality of vertically spaced impact detonatable primers; a gun structure depending from said hollow housing and mounting a plurality of vertically spaced shaped charges; a primer cord in communication with each of said shaped charges; means for transmitting the detonating energy of each of said primers to said primer cord; said hollow housing defining a fluid pressure chamber; means for supplying fluid pressure to said fluid pressure chamber for detonating the lower one of said primers; and firing means independent of said fluid pressure actuated means actuable by a free fall detonating means for impacting the upper one of said primers; whereby said upper primer may be detonated in the event said lower primer fails to detonate.

2. The apparatus of claim 1, wherein said fluid pressure actuated means comprises a hammer slidably and sealably mounted in said fluid pressure chamber for movement toward said lower primer; and latching means for securing said hammer in spaced relation to said lower primer until a predetermined fluid pressure force is exerted on said hammer to drive said hammer into impact engagement with said lower primer.

3. The apparatus of claim 2, further comprising a tubing carried packer supporting said hollow housing in depending relation and with the bore of said hollow housing aligned with the bore of the tubing string carrying the packer, whereby said packer may be set in the well casing to position said gun structure adjacent a production formation and isolate the casing annulus surrounding said hollow housing from the casing annulus above the packer; and said means for supplying fluid pressure to said fluid pressure chamber comprises first conduit means connecting the upper portion of said fluid pressure chamber to the casing annulus above said set packer and second conduit means connecting the lower portion of said fluid pressure chamber to said annulus surrounding said hollow housing, whereby an increase in casing annulus fluid pressure above said set packer over the casing annulus fluid pressure below said set packer produces a pressure differential on said hammer to actuate same.

4. The apparatus of claim 1, wherein said means for transmitting the detonating energy of said upper primer to said shaped charges comprises a detonation conducting tubing extending from said upper primer to said primer cord.

5. In a tubing carried perforating gun for a subterranean well, a firing mechanism comprising: a hollow housing attachable at its upper end to the tubing string and at its lower end to the perforating gun; a first impact detonatable primer fixedly mounted in the lower portion of said hollow housing; means for transmitting the detonating energy of said first primer to said perforating gun; a fluid pressure chamber in said housing above said detonable primer; a hammer slidably and sealably mounted in said fluid pressure chamber; latching means for releasably securing said hammer in an elevated position relative to said first primer, whereby the application of a predetermined fluid pressure differential to the upper and lower portions of said hammer will force said hammer downwardly to produce an impact blow on said primer charge to detonate same; a second impact detonatable primer fixedly mounted in said fluid pressure chamber above said elevated position of said hammer; firing means releasably secured in said fluid pressure chamber in a position above said second primer; detonation conveying means extending from said second primer to the perforating gun; a first fluid passage extending from the upper portions of said fluid pressure chamber to one of the tubing string and the annulus surrounding said hollow housing; a second fluid passage extending from the lower end of said fluid pressure chamber to the other of said tubing string and the annulus surrounding said hollow housing, whereby a predetermined differential between fluid pressure in the tubing string and fluid pressure in said annulus will release said first hammer from said latching means to impact said first primer, and, in the event said first primer fails to detonate, a detonating bar dropped through the tubing string will impact said firing means to detonate said second primer.

6. The apparatus defined in claim 5 further comprising a packer secured between the tubing string and said hollow housing, said packer being settable in the well casing to position the perforating gun adjacent the production zone to be perforated.

7. The apparatus defined in claim 6, wherein said first fluid passage comprises an axially extending passage through the packer to the casing annulus above said packer.

8. The apparatus defined in claim 6, wherein said second fluid passage comprises a radial port communicating between the bore of the tubing string and the casing annulus below said packer.

9. The method of firing a perforating gun positionable adjacent a production formation of a subterranean well by a tubing string comprising the steps of:

a. connecting a hollow firing housing intermediate the perforating gun and the tubing string;
b. fixedly mounting two primers in vertically spaced relation in the firing housing;
c. operatively connecting each primer to the perforating gun to fire the gun by detonation of either primer;
d. establishing a fluid pressure chamber within the hollow firing housing;
e. actuating a hammer by fluid pressure supplied to said fluid pressure chamber to impact the lower one of the primers; and
f. in the event said lower one of the primers fails to detonate, dropping a detonating bar through the tubing string to impact on the upper primer.

10. The method of claim 9, further comprising the step of producing a fluid pressure differential across said hammer by applying casing annulus fluid pressure to the top of said hammer and tubing pressure to the bottom of said hammer.

11. The method of claim 9, further comprising the step of supplying pressured fluid to said fluid pressure chamber both above and below said hammer; trapping the pressured fluid above said hammer; and reducing the pressure of the supplied fluid to produce a differential across said hammer to drive same into impact engagement with said lower primer.

* * * * *